US010130161B2

(12) United States Patent
Kao

(10) Patent No.: US 10,130,161 B2
(45) Date of Patent: Nov. 20, 2018

(54) BACKPACK WITH SUSPENSION ARRANGEMENT

(71) Applicant: Peter Kao, Union City, CA (US)

(72) Inventor: Peter Kao, Union City, CA (US)

(73) Assignee: Ox Distribution Group, Laguna Niguel, CA (US)

( * ) Notice: Subject to any disclaimer, the term of this patent is extended or adjusted under 35 U.S.C. 154(b) by 191 days.

(21) Appl. No.: 15/076,622

(22) Filed: Mar. 21, 2016

(65) Prior Publication Data

US 2017/0265631 A1 Sep. 21, 2017

(51) Int. Cl.
*A45F 3/12* (2006.01)
*A45F 3/04* (2006.01)

(52) U.S. Cl.
CPC ..... *A45F 3/12* (2013.01); *A45F 3/047* (2013.01)

(58) Field of Classification Search
CPC . A45C 13/30; A45F 3/04; A45F 3/047; A45F 3/02; A45F 3/12
See application file for complete search history.

(56) References Cited

U.S. PATENT DOCUMENTS 4,976,388 A * 12/1990 Coontz ..... A45C 13/30 224/150
5,411,194 A * 5/1995 Nagasawa ..... A45C 13/26 224/254
5,615,811 A * 4/1997 Bell ..... F41C 23/02 224/150
5,695,102 A * 12/1997 Jackson ..... A45C 13/30 224/257
6,375,053 B1 * 4/2002 Cecchinel ..... A45C 13/30 224/264
6,802,442 B1 * 10/2004 Thompson ..... A44B 11/14 224/259
7,100,809 B2 * 9/2006 Arnold ..... A45F 3/047 224/604
8,262,545 B1 * 9/2012 Beber ..... A63B 21/065 2/102
8,366,081 B2 * 2/2013 Staihar ..... A45C 13/001 267/69
8,833,623 B2 * 9/2014 Scicluna ..... A45C 13/30 224/607
9,192,221 B2 * 11/2015 Just ..... A45C 13/02
9,585,462 B2 * 3/2017 Engdahl ..... A45F 3/04

* cited by examiner

*Primary Examiner* — Corey Skurdal
(74) *Attorney, Agent, or Firm* — Raymond Y. Chan; David and Raymond Patent Firm

(57) ABSTRACT

A backpack includes a pack body, two length-adjustable shoulder straps extended from the pack body for allowing the wearer to wear the pack body at the wearer's back, and a suspension arrangement which includes a resilient unit provided between the pack body and the shoulder straps for absorbing a bounding force of the pack body. Therefore, the resilient unit allows a relative movement of the pack body with respect to each of the shoulder straps but minimizes the relative movement of the pack body by absorbing the bounding force of the pack body. The resilient unit is also arranged for evenly distributing a loading force of the pack body to each of the shoulder straps, such that the resilient unit absorbs the bounding force of the pack body at different directions so as to balance the uneven loading force at the pack body.

10 Claims, 8 Drawing Sheets

BACKPACK WITH SUSPENSION ARRANGEMENT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a backpack, and more particularly to a backpack with a suspension arrangement, which suspends the load at the backpack to minimize a continuous bounding movement/force of the backpack to the wearer's body when the wearers walks or runs.

Description of Related Arts

Backpacks generally comprises a bag body and two shoulder straps extended from the bag body, wherein the backpacks rely on the shoulder straps to carry the load at the bag body, the load exerts a backward pulling force at the shoulders of the wearer, causing back fatigue and strain. Especially, students, i.e. the wearers, often carry heavy books to and from school. Therefore, musculoskeletal experts are warning the parents that a young child often has an epidemic of back problems due to the continuous use of heavy backpack. According to the American Occupational Therapy Association, a student backpack should not weight more than 15 percent of the wearer's weight. When the wearer stands still, the loading force at the bag body is a static force equal to the weight of the load. However, when the wearer walks or runs, the loading force at the bag body is larger than the weight of the load. In particular, the loading force will change at all times during the body movement of the wearer. It is because the bag body will move up and down during the body movement of the wearer, wherein a gravity force is added into the weight of the load. In other words, the rapid or vigorous body movement of the wearer will dramatically increase the loading force at the bag body. For the wearers who need to carry heavy load, such as students, campers, hikers, or golfers, the loading force may not be evenly transferred to the shoulder straps. In other words, the center of mass of the wearer will shift during the body movement of the wearer, causing the wearer to trip or fail.

An improved backpack incorporates with a suspended loading device to minimize the up and down movement of the bag body. Accordingly, the suspended loading device comprises a suspension frame, wherein the shoulder straps are coupled at one side of the suspension frame and the bag body is movably coupled at another side of the suspension frame. Due to the relative movement between the bag body and the suspension frame, the up and down movement of the bag body can be minimized to transfer to the shoulder straps. However, such suspended loading device has several drawbacks. Accordingly, the suspension frame is relatively heavy added onto the weight of the bag body. Therefore, the overall weight of the backpack, including the load at the bag body and weight of the suspension frame, will directly exert to the wearer's body through the shoulder straps. In addition, more than one item is disposed in the bag body, which causes the uneven distribution of the weight of the bag body. However, the suspended loading device can only minimize the up and down movement of the bag body but cannot evenly distribute the loading force to the shoulder straps. As a result, the wearer's body will lean toward one side where the heavier load is exerted at one of the shoulder straps.

SUMMARY OF THE PRESENT INVENTION

The invention is advantageous in that it provides a backpack with a suspension arrangement, which suspends the load at the backpack to minimize a continuous bounding movement/force of the backpack to the wearer's body when the wearers walks or runs.

Another advantage of the invention is to a backpack with a suspension arrangement, which comprises a resilient unit provided between a pack body and two shoulder straps for absorbing a bounding force of the pack body. Therefore, the resilient unit allows a relative movement of the pack body with respect to each of the shoulder straps but minimizes the relative movement of the pack body by absorbing the bounding force of the pack body.

Another advantage of the invention is to a backpack with a suspension arrangement, wherein the resilient unit is adapted for evenly distributing a loading force of the pack body to each of the shoulder straps, such that the resilient unit can absorb the bounding force of the pack body at different directions, such as an up-and-down direction or a lateral direction.

Another advantage of the invention is to a backpack with a suspension arrangement, wherein the suspension arrangement not only minimizes any up-and-down movement of the backpack but also reduces any sideward swinging movement of the backpack.

Another advantage of the invention is to a backpack with a suspension arrangement, wherein a tension of the resilient unit is adjustable to incorporate with the backpack depending on the load thereat. Therefore, the wearer is able to increase the tension of the resilient unit for carrying a heavier load at the backpack or decrease the tension of the resilient unit for carrying a lighter load at the backpack.

Another object of the present invention is to provide a backpack with a suspension arrangement, which does not require to alter the original structural design of the backpack, so as to minimize the manufacturing cost of the backpack incorporating with the suspension arrangement.

Another object of the present invention is to provide a backpack with a suspension arrangement, wherein no expensive or complicated structure is required to employ in the present invention in order to achieve the above mentioned objects. Therefore, the present invention successfully provides an economic and efficient solution for minimizing any continuous bounding movement/force of the backpack to the wearer's body when the wearers walks or runs so as to prevent the cause of the back fatigue and strain for the wearer.

Additional advantages and features of the invention will become apparent from the description which follows, and may be realized by means of the instrumentalities and combinations particular point out in the appended claims.

According to the present invention, the foregoing and other objects and advantages are attained by a backpack, comprising:

a pack body configured for being disposed on a wearer's back;

a carrying system which comprises two length-adjustable shoulder straps extended from the pack body for allowing the wearer to wear the pack body at the wearer's back; and a suspension arrangement which comprises a resilient unit provided between the pack body and the shoulder straps for absorbing a bounding force of the pack body and for evenly distributing a loading force of the pack body to each of the shoulder straps so as to minimize a relative movement of the pack body with respect to each of the shoulder straps.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
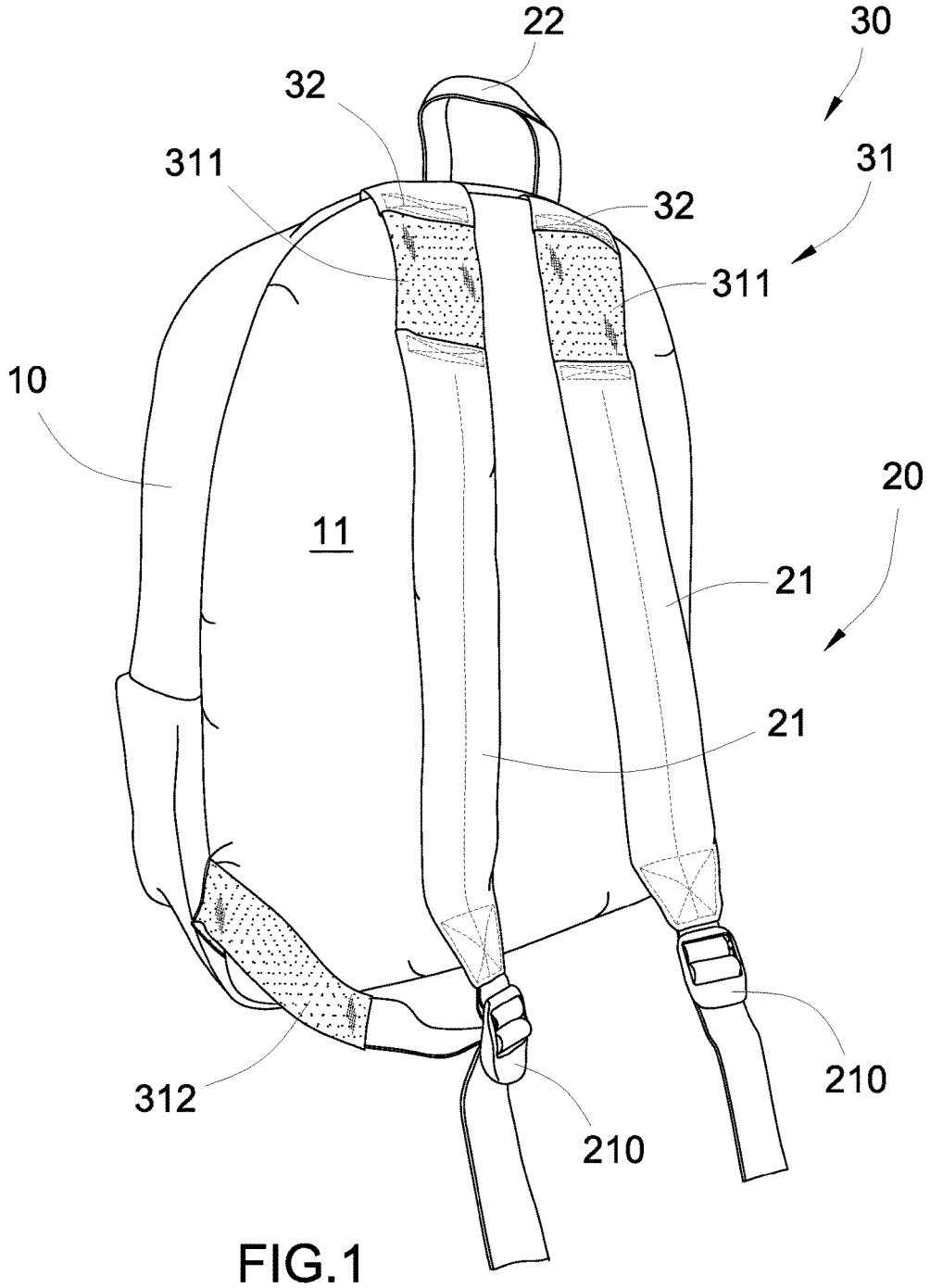
FIG. 1 is a rear perspective view of a backpack with a suspension arrangement according to a preferred embodiment of the present invention.
Figure 2:
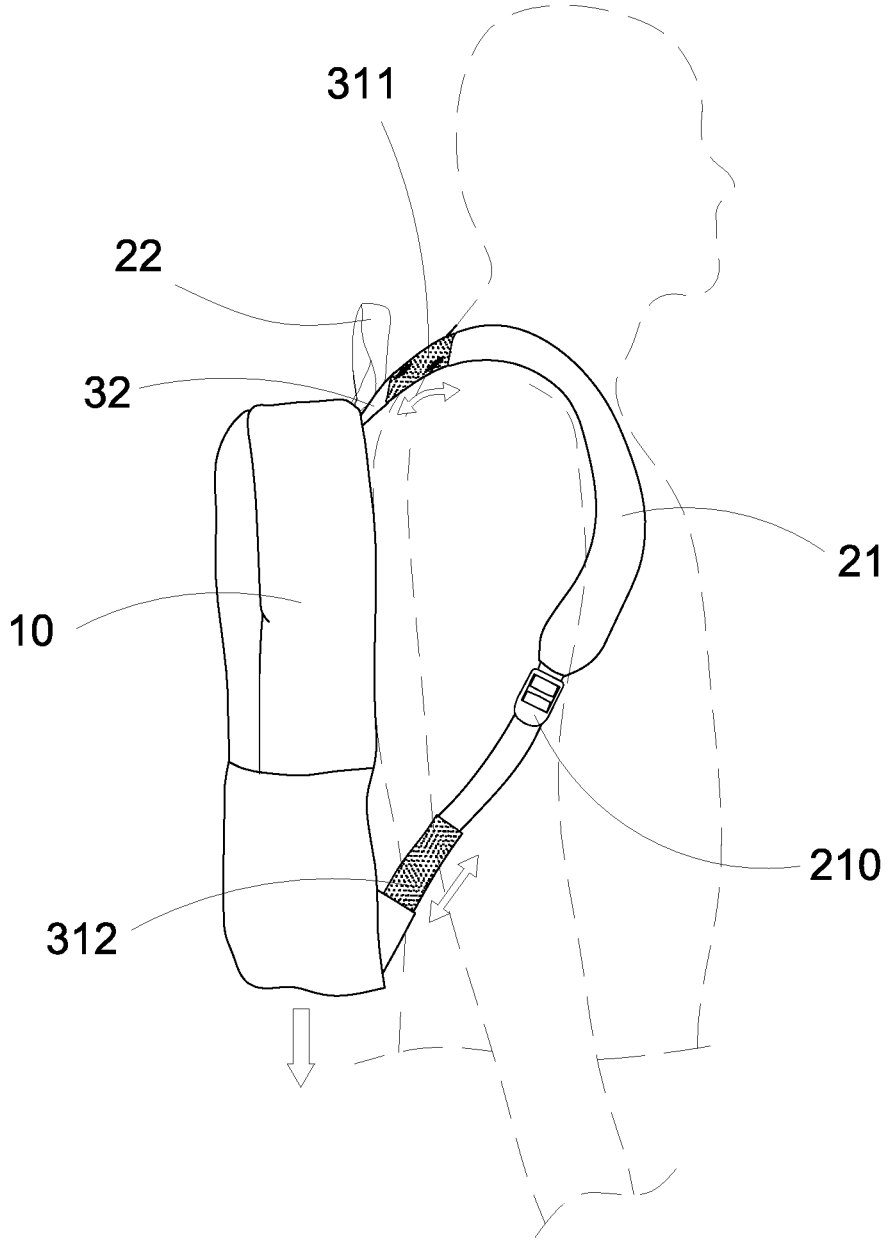
FIG. 2 is a side view of the backpack with the suspension arrangement worn by a wearer according to the above preferred embodiment of the present invention.

Referring to FIGS. 1 and 2 of the drawings, a backpack according to a preferred embodiment of the present invention is illustrated, wherein the backpack, which is an ergonomic backpack, comprises a pack body 10, a carrying system 20, and a suspension arrangement 30.

The pack body 10 is configured for being disposed on a wearer's back, wherein the pack body 10 has a storage cavity for receiving one or more items as a load of the pack body 10, wherein the pack body 10 has a back side 11.

The carrying system 20 comprises two length-adjustable shoulder straps 21 extended from the pack body 10 for allowing the wearer to wear the pack body 10 at the wearer's back. Preferably, the shoulder straps 21 are provided at the back side 11 of the pack body 10. The carrying system 20 further comprises a handle loop 22 provided on a top side of the pack body 10. Each of the shoulder straps 21 has a strap slide 210 to selectively adjust a length of the shoulder strap 21. It is worth mentioning that the strap slide 210 can also allow the lower end of the shoulder strap 21 to be detached from the pack body 10.

The suspension arrangement 30 comprises a resilient unit 31 provided between the pack body 10 and the shoulder straps 21, wherein the resilient unit 31 allows a relative movement of the pack body 10 with respect to each of the shoulder straps 21.

Accordingly, the conventional backpack is constructed that the shoulder straps are affixed to the bag body, such that conventional backpack does not provide any means for allowing the relative movement of the bag body with respect to the shoulder straps. As a result, the loading force is directly exerted to the shoulder straps from the bag body. In view of the present invention, the resilient unit 31 provides a predetermined tension between the pack body 10 and the shoulder straps 21, such that the pack body 10 can be relatively moved with respect to the shoulder straps 21.

In particular, the resilient unit 31 of the present invention generates a predetermined resilient force between the pack body 10 and the shoulder straps 21 for absorbing a bounding force of the pack body 10, especially when the wearers walks or runs, to minimize the relative movement of the pack body 10 with respect to each of the shoulder straps 21. As it is mentioned above, if there is no relative movement of the pack body 10 with respect to the shoulder straps 21, the loading force is directly exerted to the shoulder straps 21 from the pack body 10. On the other hand, when there is a relative large movement of the pack body 10 with respect to the shoulder straps 21, the bounding force of the pack body 10 will be varied in response to the movement of the pack body 10, causing the backpack to be worn uncomfortably. Therefore, the resilient unit 31 of the present invention allows the relative movement of the pack body 10 with respect to each of the shoulder straps 21 but minimizes the relative movement of the pack body 10 by absorbing the bounding force of the pack body 10.

The resilient unit 31 is also provided at the shoulder straps 21 individually for evenly distributing the loading force of the pack body 10 to each of the shoulder straps 21, such that the resilient unit 31 can absorb the bounding force of the pack body 10 at different directions, such as an up-and-down direction or a lateral direction. For example, when the items are unevenly disposed in the pack body 10, the loading force may not be exerted at a centerline of the pack body 10. As a result, the loading force may be evenly distributed to the shoulder straps 21. Since the resilient unit 31 of the present invention is provided at the shoulder straps 21 individually, the resilient unit 31 will generate the independent resilient force at each of the shoulder straps 21 to balance the uneven loading force at the pack body 10, such that the loading force can be evenly distributed the loading force of the pack body 10 to each of the shoulder straps 21.

As shown in FIG. 1, the resilient unit 31 comprises two resilient straps 311 extended from upper ends of the shoulder straps 21 respectively to the pack body 10, wherein each of the resilient straps 311 provides the resilient force to absorb the bounding force of the pack body 10 to the respective shoulder strap 21. In other words, the two resilient straps 311 provide the independent resilient forces at the shoulder straps 21 respectively to individually absorb the bounding force of the pack body 10.

The resilient unit 31 further comprises two lower resilient straps 312 extended from lower ends of the shoulder straps 21 respectively to the pack body 10, wherein the lower resilient straps 312 will also provide the resilient force to absorb the bounding force of the pack body 10 to the respective shoulder strap 21. The resilient straps 311, 312 are made of stretchable material to generate the resilient force. Preferably, the resilient straps 311 are permanently affixed between the upper ends of the shoulder straps 21 and the pack body 10, and the lower resilient straps 312 are permanently affixed between the lower ends of the shoulder straps 21 and the pack body 10. It is worth mentioning that the strap slide 210 can also allow the lower end of the shoulder strap 21 to be detached from the lower resilient straps 312 so as to detach the lower end of the shoulder strap 21 from the pack body 10.

Accordingly, the two resilient straps 311 at the upper ends of the shoulder straps 21 serve as two upper resilient straps 311, such that each of the shoulder straps 21 is coupled to the pack body 10 via the upper resilient strap 311 and the lower resilient strap 312. It is worth mentioning that the lower resilient straps 312 will pull the back side 11 of the pack body 10 close to the back of the wearer when the backpack is worn to ensure the weight of the pack body 10 to close to the center of mass of the wearer. In addition, the upper and lower resilient straps 311, 312 will provide the resilient forces at different directions of the pack body 10 for not only minimizing any up-and-down movement of the backpack but also reducing any sideward swinging movement of the backpack.

Figure 3:
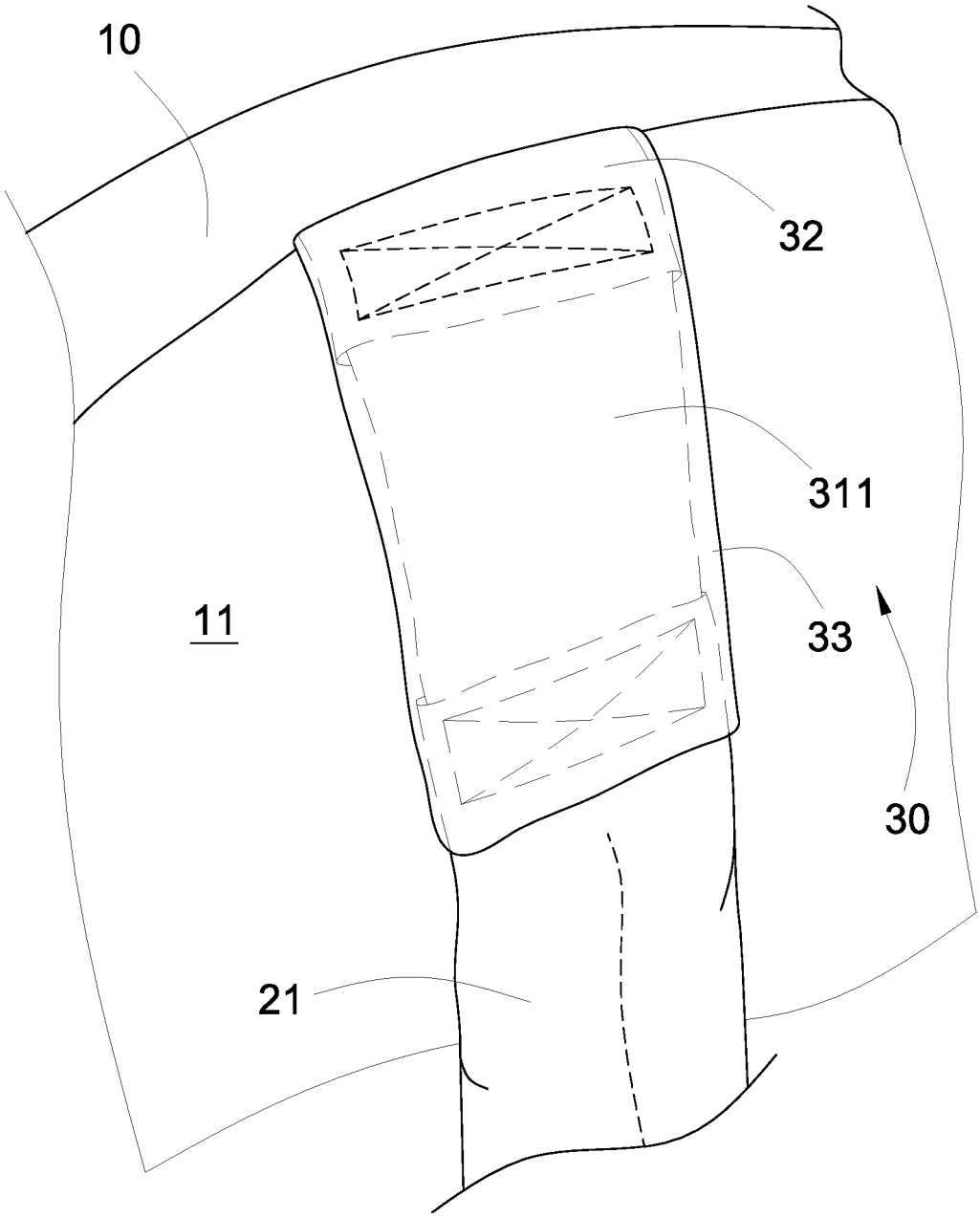
FIG. 3 is a perspective view of the suspension arrangement of the backpack according to the above preferred embodiment of the present invention.

As shown in FIG. 3, in order to secure the resilient straps 311 at the pack body 10, the suspension arrangement 30 further comprises two extension tongues 32 extended from the back side 11 of the pack body 10, wherein the resilient straps 311 are extended between the upper ends of the shoulder straps 21 and the extension tongues 32 respectively. Preferably, the extension tongues 32 are permanently and securely affixed to the back side 11 of the pack body 10 at a top edge thereof by stitching. It is worth mentioning that the two extension tongues 32 ensure the direction of force to be transferred. In particular, the two extension tongues 32 ensure the loading force at the pack body 10 to be transferred along the resilient straps 311.

As shown in FIG. 3, each of the resilient straps 311 has a rectangular shape that a width of an upper edge is the same as a width a lower edge, wherein the upper edge of the resilient strap 311 is extended from the extension tongue 32 and the lower edge of the resilient strap 311 is extended from the upper end of the shoulder strap 21. This uniform width of the resilient strap 31 will ensure the loading force to be transferred to the shoulder strap 21. In addition, the resilient force at the upper edge of the resilient strap 311 is the same as the resilient force at lower edge of the resilient strap 311 to ensure the uniform resilient force thereat to support the pack body 10. Preferably, the upper edge of the resilient strap 311 is permanently affixed to the extension tongue 32 by stitching and the lower edge of the resilient strap 311 is permanently affixed to the upper end of the shoulder strap 21 by stitching.

In addition, the suspension arrangement 30 further comprises two receiving sleeves 33 extended from the pack body to the upper ends of the shoulder straps 21 to receive the resilient straps 311 within the receiving sleeves 33 respectively in a hidden manner, as shown in FIG. 3. Each of the receiving sleeves 33 has a tubular shape to receive the resilient strap 311. Accordingly, the upper ends of the shoulder straps 21 are also received in the receiving sleeves 33 in a hidden manner. It is worth mentioning that the upper edges of the receiving sleeves 33 are affixed to secure the receiving sleeves 33 and the lower edges of the receiving sleeves 33 are non-stitched, such that the upper ends of the shoulder straps 21 can be freely slid within the receiving sleeves 33 respectively to allow the resilient straps 311 to be stretched correspondingly.

In particular, a length of each of the receiving sleeves 33 is long enough to cover the maximum length of the resilient strap 311 that the resilient strap 311 is stretched in a maximum condition between the upper edge and the lower edge. Therefore, when the backpack is worn by the wearer, the two resilient straps 311 are hidden and cannot be seen. Preferably, the two receiving sleeves 33 are extended from the extension tongues 33, preferably affix to the extension tongues 33, to the upper ends of the shoulder straps 21 to receive the resilient straps 311 within the receiving sleeves 33 respectively in a hidden manner.

Figure 4:
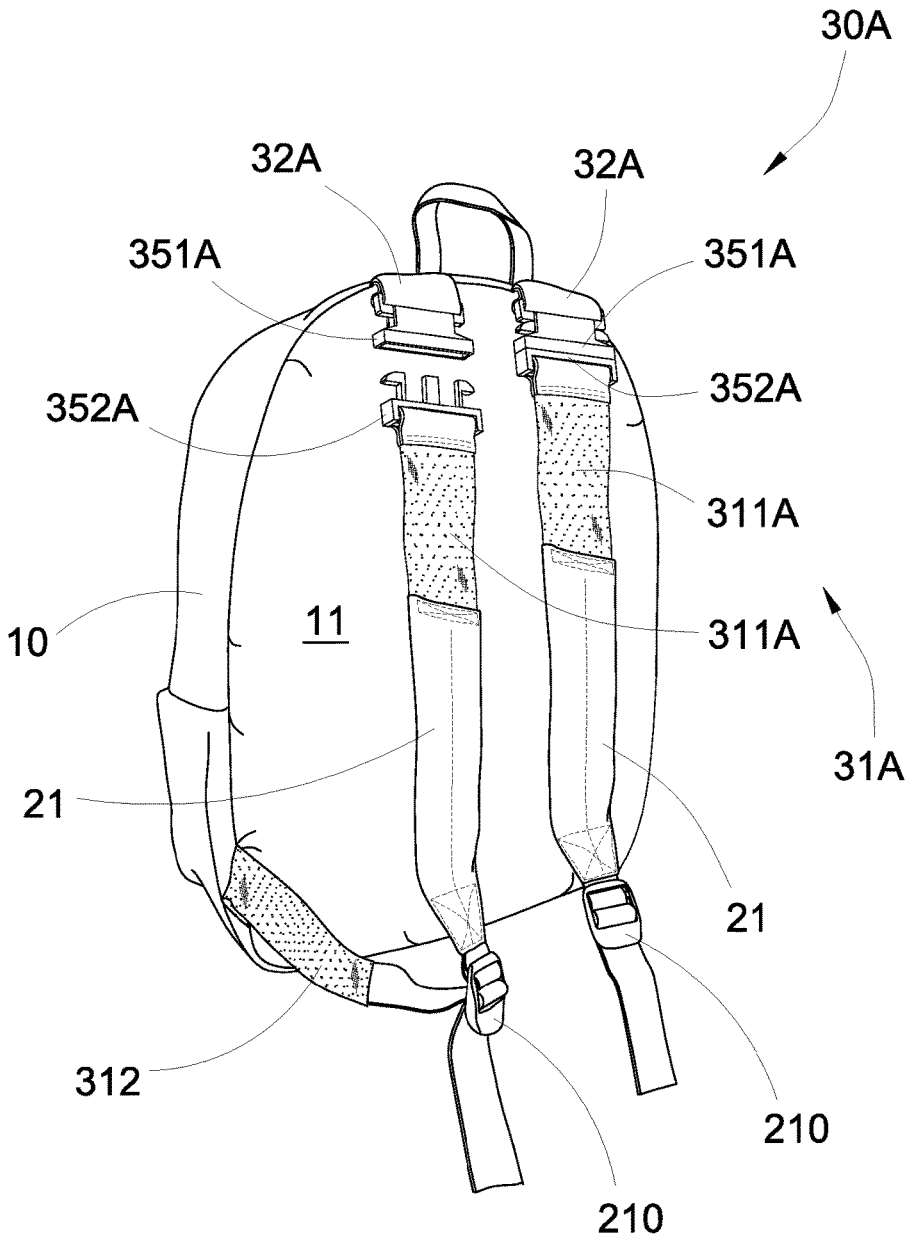
FIG. 4 illustrates a first alternative mode of the suspension arrangement of the backpack according to the above preferred embodiment of the present invention, illustrating the detachable feature of the suspension arrangement.

According to the preferred embodiment, the tension of the resilient unit 31 should be increased for carrying a heavier load at the backpack or decreased for carrying a lighter load at the backpack. FIG. 4 illustrates a first alternative mode of the suspension arrangement 30A to allow the user to adjust the tension of the resilient unit 31A. As shown in FIG. 4, the resilient straps 311A is detachably affixed to the pack body 10, such that the user is able to change different resilient straps 311A with different tensions corresponding to the load of the backpack.

Accordingly, the suspension arrangement 30A further comprises two first strap fasteners 351A extended from the back pack 10 and two second strap fasteners 352A provided at the resilient straps 311A respectively, wherein the first strap fasteners 351 are detachably coupled with the second strap fasteners 352A to detachably couple the resilient straps 311A at the pack body 10. It is worth mentioning that the upper edge of the resilient strap 311A is coupled to the second strap fastener 352A and the lower edge of the resilient strap 311A is extended from the upper end of the shoulder strap 21. Preferably, the first strap fasteners 351 are coupled at the extension tongues 32A respectively. Preferably, the first and second strap fasteners 351A, 352A are quick release buckle clip mechanism. It is appreciated the first and second strap fasteners 351A, 352A can be other fastening mechanisms such as snap hooks for detachably affixing the resilient straps 311A to the pack body 10. It is worth mentioning that the receiving sleeves 33 can be incorporated with this detachably affixing structure to cover the first and second strap fasteners 351A, 352A.

Figure 5:
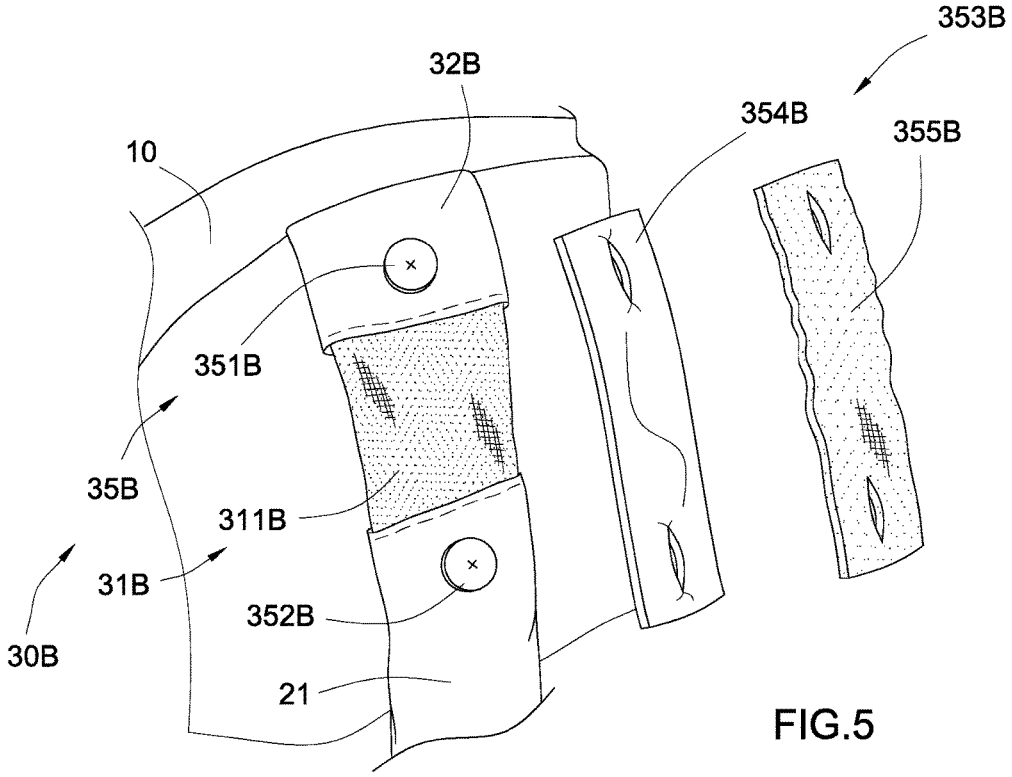
FIG. 5 illustrates a second alternative mode of the suspension arrangement of the backpack according to the above preferred embodiment of the present invention, illustrating the tension adjustment of the suspension arrangement.

FIG. 5 illustrates a second alternative mode the suspension arrangement 30B to allow the user to adjust the tension of the resilient unit 31B via a tension adjusting unit 35B. In particular, the user is able to adjust selectively adjust the tension of each of said resilient straps 311B via the tension adjusting unit 35B. As shown in FIG. 5, the tension adjusting unit 35B comprises a first adjusting fastener 351B provided at the pack body 10, a second adjusting fastener 352B provided at each of the shoulder straps 21, and a tension adjustor 353B detachably fastening the first and second adjusting fasteners 351B, 352B to selectively adjust the tension of the respective resilient strap 311B. Preferably, two first adjusting fasteners 351B are provided at the extension tongues 32B respectively and two second adjusting fastener 352B are provided at the upper ends of the shoulder straps 21 respectively. Therefore, the tension of each of said resilient straps 311B can be selectively adjusted via the tension of the tension adjustor 353B.

Accordingly, when the tension adjustor 353B is made of non-stretchable material to serve as a non-stretchable member 354B detachably fastening the first and second adjusting fasteners 351B, 352B, the distance between the pack body 10 and the upper end of the shoulder strap 21 is fixed to restrict the respective resilient strap 311B to be stretched. When the tension adjustor 353B is made of stretchable material to serve as a stretchable member 355B detachably fastening the first and second adjusting fasteners 351B, 352B, the tension adjustor 353B has a predetermined tension added on to each of the resilient straps 311B. Therefore, the overall tension of the resilient strap 311B and the tension adjustor 353B will be increased for carrying a heavier load of the pack body 10. Preferably, the first and second adjusting fasteners 351B, 352B are two buttons, wherein two button holes are formed at two end portions of the tension adjustor 353B to detachably fasten the tension adjustor 353B with the first and second adjusting fasteners 351B, 352B. It is appreciated that different fasteners can be used for detachably fastening the tension adjustor 353B between the pack body 10 and the shoulder strap 21. Therefore, depending the load of the pack body 10, the user is able to change different tension adjustors 353B to adjust selectively adjust the tension of each of said resilient straps 311B.

Figure 6:
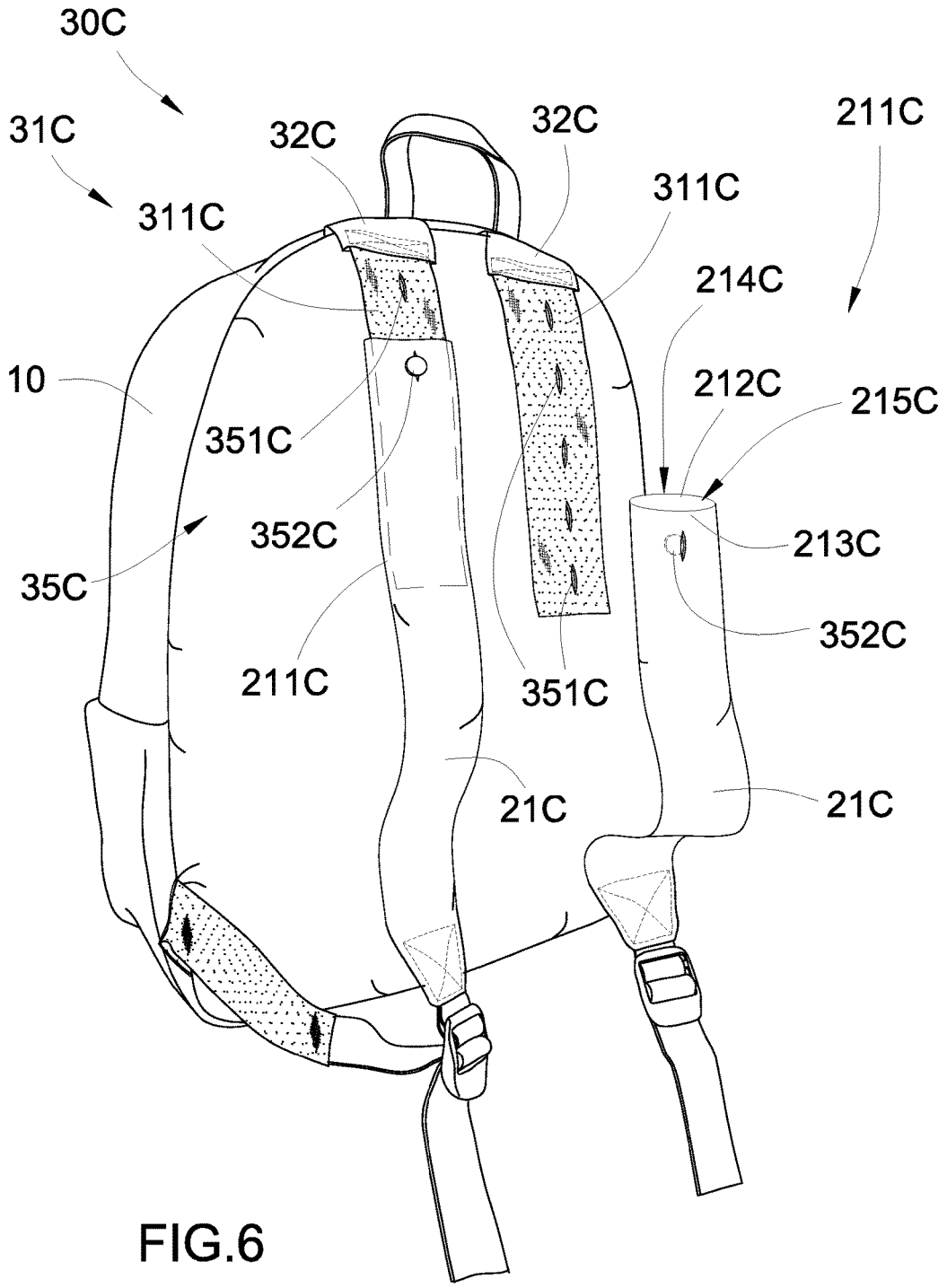
FIG. 6 illustrates a third alternative mode of the suspension arrangement of the backpack according to the above preferred embodiment of the present invention, illustrating the alternative tension adjustment of the suspension arrangement.

FIG. 6 illustrates a third alternative mode the suspension arrangement 30C to allow the user to adjust the tension of the resilient unit 31C via a tension adjusting unit 35C. As shown in FIG. 6, each of the shoulder straps 21C comprises a cushioning sleeve 211C defining an inner cushioning layer 212C and an outer cushioning layer 213C overlapped thereon, wherein a sliding cavity 214C is formed between said inner and outer cushioning layers 212C, 213C and a top opening 215C formed at the upper end of the shoulder straps 21C to communicate with the sliding cavity 214C.

Each of the resilient straps 311C is extended from the pack body 10 to slidably receive in the cushioning sleeve 211C. In particular, each of the resilient straps 311C is securely extended from the extension tongues 32C at the pack body 10 to slidably receive within the sliding cavity 214C through the top opening 215C.

The tension adjusting unit 35C comprises a plurality of first tension fasteners 351C spacedly formed at each of the resilient straps 311C and a second tension fastener 352C formed at the cushioning sleeve 211C to selectively fasten with one of the first tension fasteners 351C so as to selectively adjust the tension of the resilient strap 311C.

Accordingly, the first tension fasteners 351C are embodied as a plurality of first button holes spacedly formed along the resilient straps 311C. The second tension fastener 352C comprises a fastening button provided at the cushioning sleeve 211C to selectively fasten with one of the first button holes to detachably affix the resilient strap 311C at the cushioning sleeve 211C. Preferably, the second tension fastener 352C further has a second button hole formed at the outer cushioning layer 213C, wherein the fastening button is provided at the inner cushioning layer 212C to align with the second button hole. Therefore, when the resilient strap 311C is slid within the sliding cavity 214C to selectively align the second button hole with one of the first button holes, the fastening button is fastened with the first and second button holes to affix the resilient strap 311C at the cushioning sleeve 211C. As the longer length of the resilient strap 311C being exposed out of the cushioning sleeve 21C, the tension of the resilient strap 311C will be increased. In other words, the wearer is able to increase the tension of each of the resilient straps 311C by lengthening the portion of the resilient strap 311C exposed out of the cushioning sleeve 211C and is able to reduce the tension of each of the resilient straps 311C by shortening the portion of the resilient strap 311C exposed out of the cushioning sleeve 211C. It is worth mentioning that the receiving sleeves 33 can be incorporated with this detachably affixing structure that the receiving sleeve 33 is extended to cover the top opening 215C of each of the cushioning sleeve 211C of the shoulder strap 211C.

Figure 7:
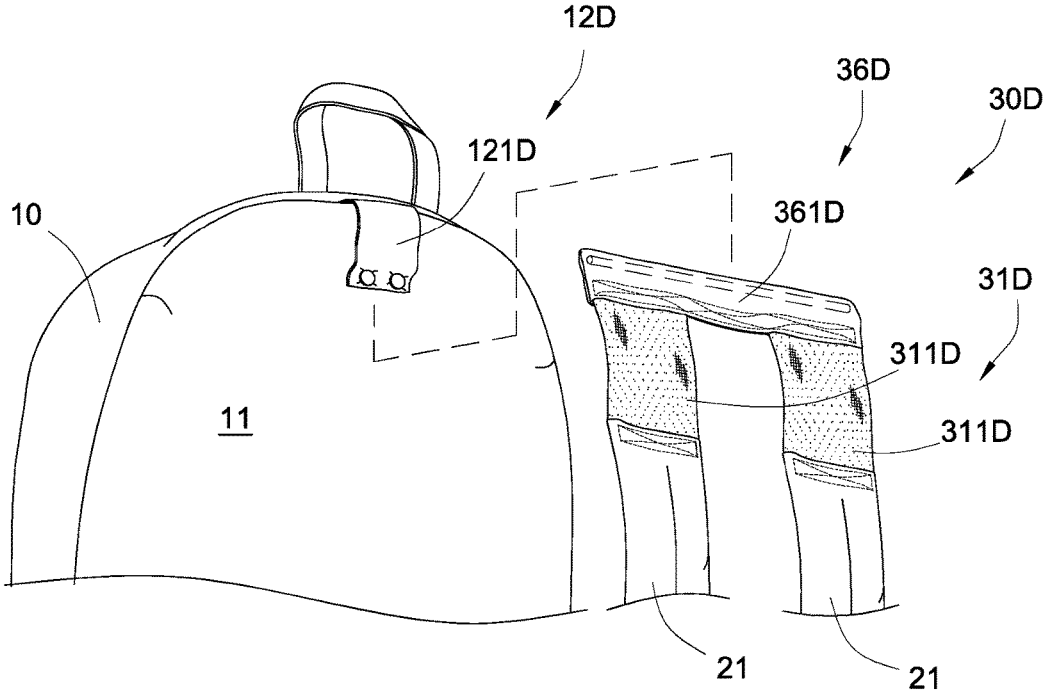
FIG. 7 illustrates a fourth alternative mode of the suspension arrangement of the backpack according to the above preferred embodiment of the present invention.

FIG. 7 illustrates a fourth alternative mode the suspension arrangement 30D to allow the user to adjust the tension of the resilient unit 31D. Accordingly, the suspension arrangement 30D further comprises a back supporting member 36D detachably coupled to the back side 11 of the pack body 10, wherein the resilient unit 31D is provided between the back supporting member 36D and the shoulder straps 21.

As shown in FIG. 7, the back supporting member 36D comprises an elongated attachment member 361D extended between two upper ends of the resilient straps 311D in a transverse direction, such that the resilient straps 311D and the attachment member 361D form an inverted "U" shaped configuration. Accordingly, when the attachment member 361D is detachably coupled at the pack body 10, the upper ends of the resilient straps 311D are coupled at the back side of the pack body 10. Preferably, the attachment member 361D is made of rigid but light weight material.

The pack body 10 further comprises a receiving pocket 12D formed at the back side 11 of the pack body 10 to receive the back supporting member 36D. As shown in FIG. 7, the receiving pocket 12D is formed at the top edge of the pack body 10. In particular, the receiving pocket 12D comprises a pocket leaf 121D having one affixing edge firmly affixed to the pack body 10 and an opposed detachable edge detachably coupling at the back side 11 of the pack body 10 to overlap the pocket leaf 121D thereon so as to form a pocket cavity between the pocket leaf 121D and the back side 11 of the pack body 10. The width of the pocket leaf 121D is slightly smaller than a length of the attachment member 361D, such that the attachment member 361D can be tightly wrapped within the pocket cavity of the pocket leaf 121D. It is appreciated that the detachable edge of the pocket leaf 121D can be detachably coupled at the back side 11 of the pack body 10 via snap buttons, button and button hole attachment, hook and loop fasteners, zippers, or the like. Therefore, the wearer is able to change the resilient unit 31D by detaching the resilient unit 31D from the receiving pocket 12D and by re-attaching the desired resilient unit 31D with proper tension thereof to the receiving pocket 12D.

Figure 8:
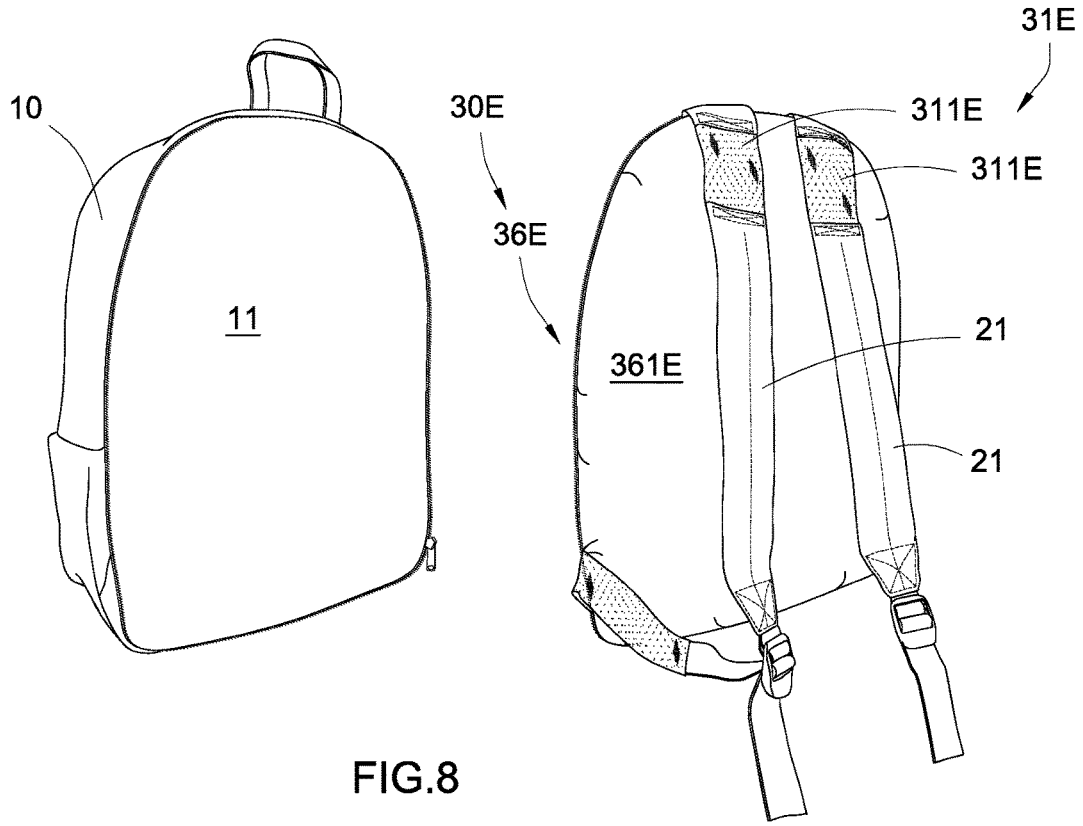
FIG. 8 illustrates a fifth alternative mode of the suspension arrangement of the backpack according to the above preferred embodiment of the present invention.

FIG. 8 illustrates another alternative mode the back supporting member 36E of the suspension arrangement 30E to allow the user to adjust the tension of the resilient unit 31E. The back supporting member 36E comprises a cushioning panel 361E shaped and sized corresponding to the back side 11 of the pack body 10, wherein the resilient straps 311E are extended from the cushioning panel 361E. In addition, the shoulder straps 21 are also extended from the cushioning panel 361E to affix with the resilient straps 311D respectively. As shown in FIG. 8, the cushioning panel 361E is detachably coupled at the back side 11 of the pack body 10. Accordingly, a peripheral edge portion of the cushioning panel 361E is detachably coupled at a peripheral edge portion of the back side 11 of the pack body 10 via a fastening means. Preferably, the fastening means can be a zipper. Alternatively, the fastening means can be snap buttons, button and button hole attachment, hook and loop fasteners, or the like. Therefore, the wearer is able to change the resilient unit 31E by detaching the cushioning panel 361E from the pack body 10 and by re-attaching the cushioning panel 361E with the desired tension of the resilient unit 31E to the back side 11 of the pack body 10.

Accordingly, all the features in the above preferred embodiment and its alternatives are interchangeable to achieve the objective of the present invention. In particular, the two resilient straps are made of elastic fabric to provide a predetermined tension to absorb the bounding force of the load at the backpack. The tension of each resilient strap will be self-adjusted corresponding to the load at the backpack to ensure the loading force to be evenly distributed at the shoulder straps. Therefore, the present invention provides a simple but effective configuration for minimizing any continuous bounding movement/force of the backpack to the wearer's body when the wearers walks or runs so as to prevent the cause of the back fatigue and strain for the wearer.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A backpack, comprising:

a pack body configured for being disposed on a wearer's back;

a carrying system which comprises two length-adjustable shoulder straps extended from said pack body for allowing the wearer to wear said pack body at the wearer's back; and a suspension arrangement which comprises:

a resilient unit provided between said pack body and said shoulder straps for absorbing a bounding force of said pack body and for evenly distributing a loading force of said pack body to each of said shoulder straps so as to minimize a relative movement of said pack body with respect to each of said shoulder straps, wherein said resilient unit comprises two resilient straps extended from upper ends of said shoulder straps respectively to said pack body, such that each of said resilient straps provides a resilient force to absorb said bounding force of said pack body to said respective shoulder strap, two extension tongues extended from a back side of said pack body, wherein said resilient straps are extended between said upper ends of said shoulder straps and said extension tongues respectively, and a tension adjusting unit for selectively adjusting a tension of each of said resilient straps, wherein said tension adjusting unit comprises a first adjusting fastener provided at each of said extension tongues, a second adjusting fastener provided at each of said shoulder straps, and a tension adjustor detachably fastening said first and second adjusting fasteners to selectively adjust the tension of said respective resilient strap.

2. The backpack, as recited in claim 1, wherein said tension adjustor is a non-stretchable member detachably fastening said first and second adjusting fasteners to restrict said respective resilient strap to be stretched.

3. The backpack, as recited in claim 1, wherein said tension adjustor has a predetermined tension added on to each of said resilient straps.

4. A backpack, comprising:

a pack body configured for being disposed on a wearer's back;

a carrying system which comprises two length-adjustable shoulder straps extended from said pack body for allowing the wearer to wear said pack body at the wearer's back; and a suspension arrangement which comprises:

a back supporting member detachably coupled to a back side of said pack body, and a resilient unit provided between said back supporting member of said pack body and said shoulder straps for absorbing a bounding force of said pack body and for evenly distributing a loading force of said pack body to each of said shoulder straps so as to minimize a relative movement of said pack body with respect to each of said shoulder straps, wherein said resilient unit comprises two resilient straps extended from upper ends of said shoulder straps respective to said back supporting member, such that each of said resilient straps provides a resilient force to absorb said bounding force of said pack body to said respective shoulder straps, wherein said back supporting member is extended between two ends of said resilient straps and is detachably coupled at said pack body at said back side thereof.

5. The backpack, as recited in claim 4, wherein said pack body has a receiving pocket formed at said back side of said pack body to receive said back supporting member.

6. A backpack, comprising:

a pack body configured for being disposed on a wearer's back;

a carrying system which comprises two length-adjustable shoulder straps extended from said pack body for allowing the wearer to wear said pack body at the wearer's back; and a suspension arrangement which comprises:

a back supporting member detachably coupled to a back side of said pack body, wherein a peripheral edge of said back supporting member is detachably coupled at said back side of said pack body via a zipper, and a resilient unit provided between said back supporting member of said pack body and said shoulder straps for absorbing a bounding force of said pack body and for evenly distributing a loading force of said pack body to each of said shoulder straps so as to minimize a relative movement of said pack body with respect to each of said shoulder straps, wherein said resilient unit comprises two resilient straps extended from upper ends of said shoulder straps respective to said back supporting member, such that each of said resilient straps provides a resilient force to absorb said bounding force of said pack body to said respective shoulder straps.

7. A backpack, comprising:

a pack body configured for being disposed on a wearer's back;

a carrying system which comprises two length-adjustable shoulder straps extended from said pack body for allowing the wearer to wear said pack body at the wearer's back; and a suspension arrangement which comprises a resilient unit provided between said pack body and said shoulder straps for absorbing a bounding force of said pack body and for evenly distributing a loading force of said pack body to each of said shoulder straps so as to minimize a relative movement of said pack body with respect to each of said shoulder straps, wherein said resilient unit comprises two upper resilient straps extended from upper ends of said shoulder straps respectively to said pack body and two lower resilient straps extended from lower ends of said shoulder straps respectively to said pack body, such that each of said upper and lower resilient straps provides a resilient force to absorb said bounding force of said pack body to said respective shoulder strap.

8. The backpack, as recited in claim 7, wherein said upper resilient straps are permanently affixed between said upper ends of said shoulder straps and said pack body, and said lower resilient straps are permanently affixed between said lower ends of said shoulder straps and said pack body.

9. The backpack, as recited in claim 7, wherein said upper resilient straps are detachably affixed between said upper ends of said shoulder straps and said pack body, and said lower resilient straps are detachably affixed between said lower ends of said shoulder straps and said pack body.

10. A backpack, comprising:

a pack body configured for being disposed on a wearer's back;

a carrying system which comprises two length-adjustable shoulder straps extended from said pack body for allowing the wearer to wear said pack body at the wearer's back, wherein each of said shoulder straps comprises a cushioning sleeve affixed to said pack body; and a suspension arrangement which comprises:

a resilient unit provided between said pack body and said shoulder straps for absorbing a bounding force of said pack body and for evenly distributing a loading force of said pack body to each of said shoulder straps so as to minimize a relative movement of said pack body with respect to each of said shoulder straps, wherein said resilient unit comprises two resilient straps extended from said pack body to detachably receive in said cushioning sleeves respectively, such that each of said resilient straps provides a resilient force to absorb said bounding force of said pack body to said respective shoulder strap, and a plurality of first tension fasteners spacedly formed at each of said resilient straps and a second tension fastener formed at said cushioning sleeve to selectively fasten with one of said first tension fasteners so as to selectively adjust a tension of said resilient strap.

* * * * *